US007421754B1

(12) United States Patent
Elliott

(10) Patent No.: US 7,421,754 B1
(45) Date of Patent: Sep. 9, 2008

(54) HOSE LIFTER FOR AN UNDERWATER POOL CLEANING DEVICE

(76) Inventor: Ray Elliott, 2679 E. Ridge Dr., Palm Harbor, FL (US) 34683

( * ) Notice: Subject to any disclaimer, the term of this patent is extended or adjusted under 35 U.S.C. 154(b) by 807 days.

(21) Appl. No.: 10/937,676

(22) Filed: Sep. 9, 2004

(51) Int. Cl.
*E04H 4/16* (2006.01)

(52) U.S. Cl. ..... 15/246; 15/1.7; 134/167 R; 138/103; 210/242.1; 441/133; 4/490

(58) Field of Classification Search ..... 15/1.7, 15/246; 134/167 R; 138/103, 107; 210/167.1, 210/167.16, 242.1; 441/133; 4/490
See application file for complete search history.

(56) References Cited

U.S. PATENT DOCUMENTS

| | | | | | |
|---|---|---|---|---|---|
| 2,989,185 | A | * | 6/1961 | Lombardi | 210/776 |
| 3,332,093 | A | * | 7/1967 | Skinner et al. | 441/133 |
| 3,489,182 | A | * | 1/1970 | Cameron | 138/103 |
| 4,188,679 | A | * | 2/1980 | Hollaender et al. | 441/133 |
| 5,398,362 | A | | 3/1995 | Chauvier | 15/1.7 |
| 5,802,653 | A | | 9/1998 | Roumagnac | 15/1.7 |
| 5,852,984 | A | | 12/1998 | Matsuyama | 114/222 |
| 6,125,492 | A | | 10/2000 | Prowse | 15/1.7 |
| 6,423,217 | B1 | | 7/2002 | Campbell | 210/169 |

FOREIGN PATENT DOCUMENTS

| | | | |
|---|---|---|---|
| DE | 2004007 | * | 9/1970 |
| DE | 3045901 | * | 7/1982 |
| GB | 1580030 | * | 11/1980 |
| ZA | 9907666 | * | 8/2000 |

* cited by examiner

*Primary Examiner*—Mark Spisich
(74) *Attorney, Agent, or Firm*—Goldstein Law Offices, P.C.

(57) ABSTRACT

A buoyant hose lifter which selectively attaches to a portion of an existing hose of an underwater pool cleaning device, wherein the buoyancy of the hose lifter may be selectively varied by a user, thereby enabling the hose lifter and the underwater pool cleaning device attached thereunto to float at different vertical levels within the water of a swimming pool, thereby enabling the cleaning device to clean vertically elevated portions of the pool.

9 Claims, 3 Drawing Sheets

HOSE LIFTER FOR AN UNDERWATER POOL CLEANING DEVICE

BACKGROUND OF THE INVENTION

1. Field of the Invention

The invention generally relates to an accessory for a pool cleaning device, and in particular relates to a buoyant hose lifter which selectively attaches to a portion of an existing hose of an underwater pool cleaning device, wherein the buoyancy of the hose lifter may be selectively varied by a user, thereby enabling the hose lifter and the pool cleaning device attached thereunto to float at different vertical levels within the water of a swimming pool, thereby enabling the user to clean vertically elevated portions of the pool with the pool cleaning device.

2. Description of the Related Art

Swimming pools require maintenance in order to keep the water contained therein free from particulate matter such as debris, bacteria, and algae. Various filtration and chemical treatments have been devised to filter or otherwise remove particulate matter from the water. Nonetheless, particulate matter will periodically accumulate on the bottom and on the side walls of the pool. Many individuals employ automated underwater pool cleaning devices to clean a swimming pool. Some of these are vacuum cleaners that suck up particulate matter. Generally, an individual employing an automatic underwater pool cleaning device must manually clean portions of the side walls which are elevated above the bottom of the pool. This requires the individual to expend a substantial amount of energy. Accordingly, there is a need for a buoyant hose lifter which selectively attaches to the portion of an existing hose of an underwater pool cleaning device nearest to the pool cleaning device, wherein the buoyancy of the hose lifter may be selectively varied by a user, thereby enabling the hose lifter and the pool cleaning device attached thereunto to float at different vertical levels within the water, thereby enabling the user to clean vertically elevated portions of the pool with the pool cleaning device.

A variety of swimming pool cleaning devices have been created. For example, U.S. Pat. No. 5,852,984 to Matsuyama appears to show an underwater vehicle for inspection of underwater constructions, having a body and having a float at the front portion of the body so that the body suspends in the water with its front portion being up. Additionally, U.S. Pat. No. 6,125,492 to Prowse appears to show a swimming pool cleaning device that when coupled to a water vacuum hose and water filter pump is capable of travelling over and cleaning an underwater surface of a pool. Furthermore, U.S. Pat. No. 6,423,217 to Campbell appears to show a swimming pool suction cleaner for cleaning an underwater surface of a pool, having a water inlet configured to be positioned on an inner surface of a pool and at least one elongate member coupled to the water intake inlet, said elongate member having an interior surface configured to generate a vortex effect on fluid flowing through the elongate member. What's more, U.S. Pat. No. 5,398,362 to Chauvier appears to show a filtration device for automatic swimming pool cleaners which keeps the pool cleaner submerged and prevents it from rising above the water surfaces of the pool. Also, U.S. Pat. No. 5,802,653 to Roumagnac appears to show a device for automatically cleaning the bottom and walls of a swimming pool.

While these devices may be suitable for the particular purpose employed, or for general use, they would not be as suitable for the purposes of the present invention as disclosed hereafter.

SUMMARY OF THE INVENTION

It is an object of the invention to provide a hose lifter which enables a user to suspend an automated underwater pool cleaning device at an elevated height within the water of a swimming pool, thereby enabling the user to clean vertically elevated portions of the pool with the pool cleaning device. Accordingly, the buoyant hose lifter selectively attaches to the portion of the hose of the underwater pool cleaning device nearest to the pool cleaning device, and floats within the water, thereby enabling the user to clean vertically elevated portions of the pool with the pool cleaning device.

It is another object of the invention to provide a hose lifter which is capable of selectively maintaining an underwater pool cleaning device at a number of different levels within the water of the pool, so that the underwater pool cleaner may be used to clean portions of the side walls of the pool which are at different heights above the bottom of the pool. Accordingly, the buoyancy of the hose lifter may be varied by the user, thereby enabling the hose lifter to float at different levels within the water of the pool, so that the underwater pool cleaner may be used to clean portions of the side walls of the pool which are at different heights above the bottom of the pool.

It is yet another object of the invention to provide a hose lifter that is not unduly expensive. Accordingly, the materials from which the hose lifter is constructed are readily available and the cost of the hose lifter is not prohibitive.

Further objects of the invention will become apparent in the detailed description of the invention that follows.

The invention is a buoyant hose lifter which selectively attaches to a portion of an existing hose of an underwater pool cleaning device, wherein the buoyancy of the hose lifter may be selectively varied by a user, thereby enabling the hose lifter and the underwater pool cleaning device attached thereunto to float at different vertical levels within the water of a swimming pool, thereby enabling the cleaning device to clean vertically elevated portions of the pool.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
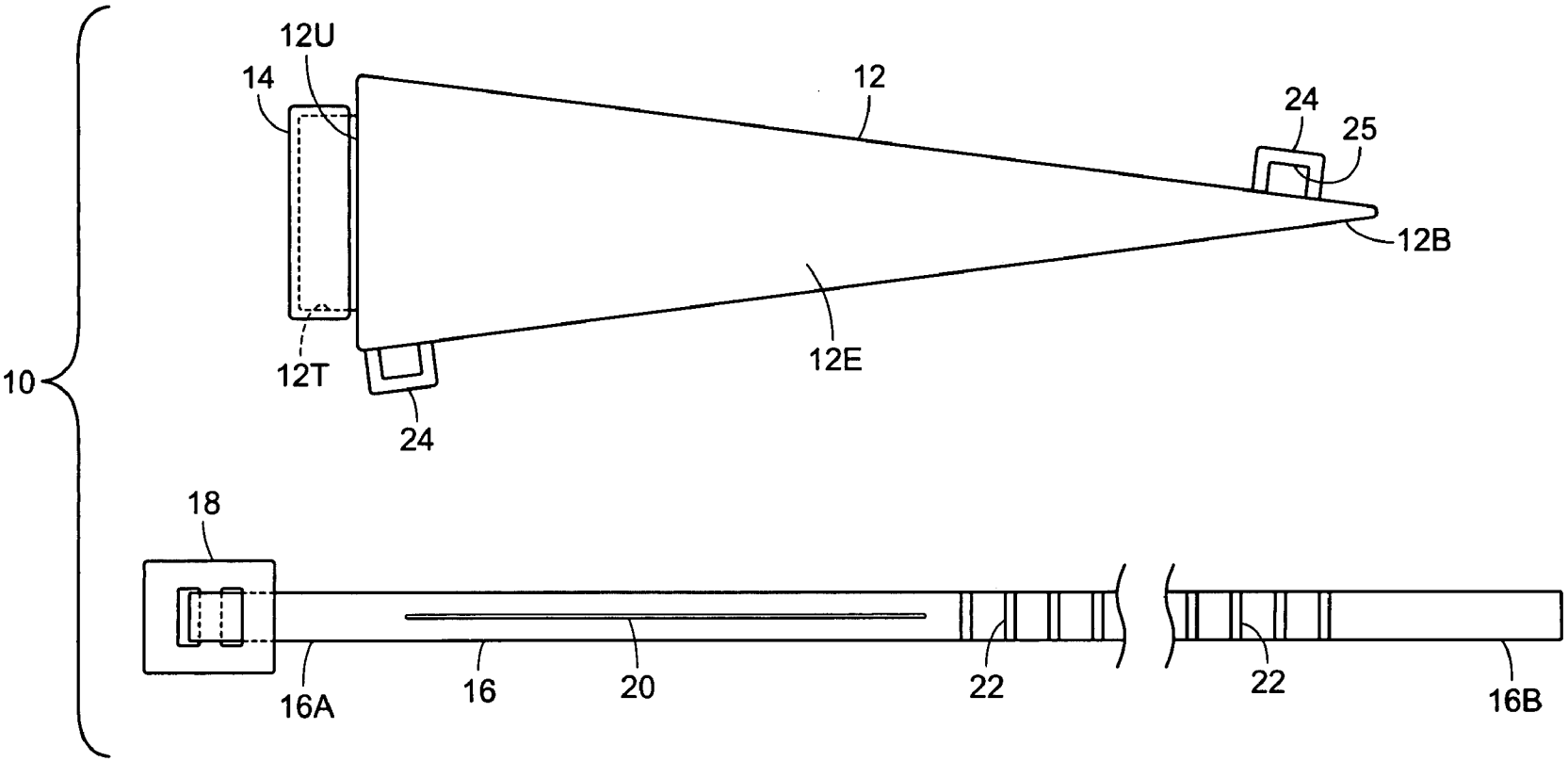
FIG. 1 is a side view of a hose lifter, comprising a float and two straps, wherein an opening in the top of the float is covered by a float screw cap, and wherein only one of the two straps is shown.

FIG. 1 illustrates a hose lifter 10, for use in conjunction with a swimming pool and with an underwater pool cleaning device having a hose extending therefrom. The pool cleaning device is selectively submerged within the water contained within the swimming pool when cleaning the side walls and bottom of the pool becomes necessary. The hose lifter 10 is selectively attached to a portion of the hose. The hose lifter 10 is capable of floating at different vertical levels within the water of the swimming pool, thereby also allowing a user to suspend the attached hose and cleaning device at different levels within the water of the pool.

The hose lifter 10 generally comprises a hollow transparent float 12, a screw cap 14, and two substantially identical elongated straps 16. Only one of the two straps 16 is shown. The float 12 has a bottom 12B, a top 12T having peripheral threads, an opening 12U at the top 12T, and an external surface 12E. The float 12 tapers towards the bottom 12B. The external surface 12E of the float 12 has a pair of spatially separated strap slots 24 located in proximity to the bottom 12B of the float 12, and additionally has a strap slot 24 located in proximity to the top 12T of the float 12. Each of the slots 24 has a slot opening 25. In order to selectively attach the float 12 to a portion of the hose, one of the straps 16 is extended through the openings 25 in the pair of spatially separated strap slots 24 located in proximity to the bottom 12B of the float 12, and the other strap 16 is extended through the opening 25 of the strap slot 24 located in proximity to the top 12T of the float 12. The straps 16 are then wrapped around the hose 40. The substantially cylindrical screw cap 14 has threads that line its internal surface and which match the peripheral threads of the top 12T of the float 12, thereby allowing the user to selectively seal the opening 12U of the float 12 by threading the screw cap 14 onto the top 12T of the float 12. The straps 16 have a first end 16A, a second end 16B, and a buckle 18 at the first end 16A. Lateral ribs circumscribe many existing swimming pool hoses. Accordingly, the straps 16 each have a longitudinal slit 20 in order that they may better engage the ribs of the hose so that the hose lifter 10 will be maintained in the correct position upon the hose once it has been selectively affixed thereunto. Each strap 16 has a plurality of lateral ribs 22 in proximity to the second end 16B for selectively preventing the second end 16B of the strap 16 from inadvertently slipping out of the buckle 18 while the hose lifter 10 is being deployed.

The buoyancy of the hose lifter 10 may be selectively varied by the user, thereby enabling the hose lifter 10 to float at different vertical levels within the water of the pool. The variable buoyancy of the hose lifter 10 enables a user to use the underwater pool cleaning device for cleaning portions of the side walls of the pool which are at different vertical heights above the bottom of the pool. In particular, the user adjusts the buoyancy of the float 12 by selectively filling the float 12 with different amounts of water after removing the screw cap 14 from the opening 12U at the top 12T of the float 12. When the requisite amount of water has been added to achieve the desired buoyancy of the float 12, the screw cap 14 is threaded back onto the top 12T of the float 12 to prevent water from leaking out of or into the float 12 while the hose lifter 10 is being deployed within the water of a swimming pool.

When the float 12 is completely filled with water, the hose lifter 10 is least buoyant, and the hose lifter 10 and the cleaning device attached thereunto will sink to the bottom of the pool, thereby allowing the user to remove particulate matter therefrom. The water in the pool has an upper surface. When the float 12 is one-half filled with water, the cleaning device will be suspended approximately twelve inches below the upper surface of the water, thereby allowing the user to utilize the cleaning device to remove particulate matter from portions of the side walls of the pool that are approximately twelve inches below the upper surface of the water. When the float 12 is two-thirds filled with water, the cleaning device will be suspended between the upper surface of the water and approximately twenty inches below the upper surface of the water, thereby allowing the cleaning device to remove particulate matter from portions of the side walls of the pool that are situated between the upper surface of the water and approximately twenty inches below the upper surface of the water. It should be noted that the amount of water the user must add to the float 12 in order to achieve a buoyancy which will maintain the hose lifter 10 at a particular vertical height above the swimming pool bottom may vary depending on the suction pressure of the pool cleaning device, and depending on the weight of the hose of the pool cleaning device.

Figure 2:
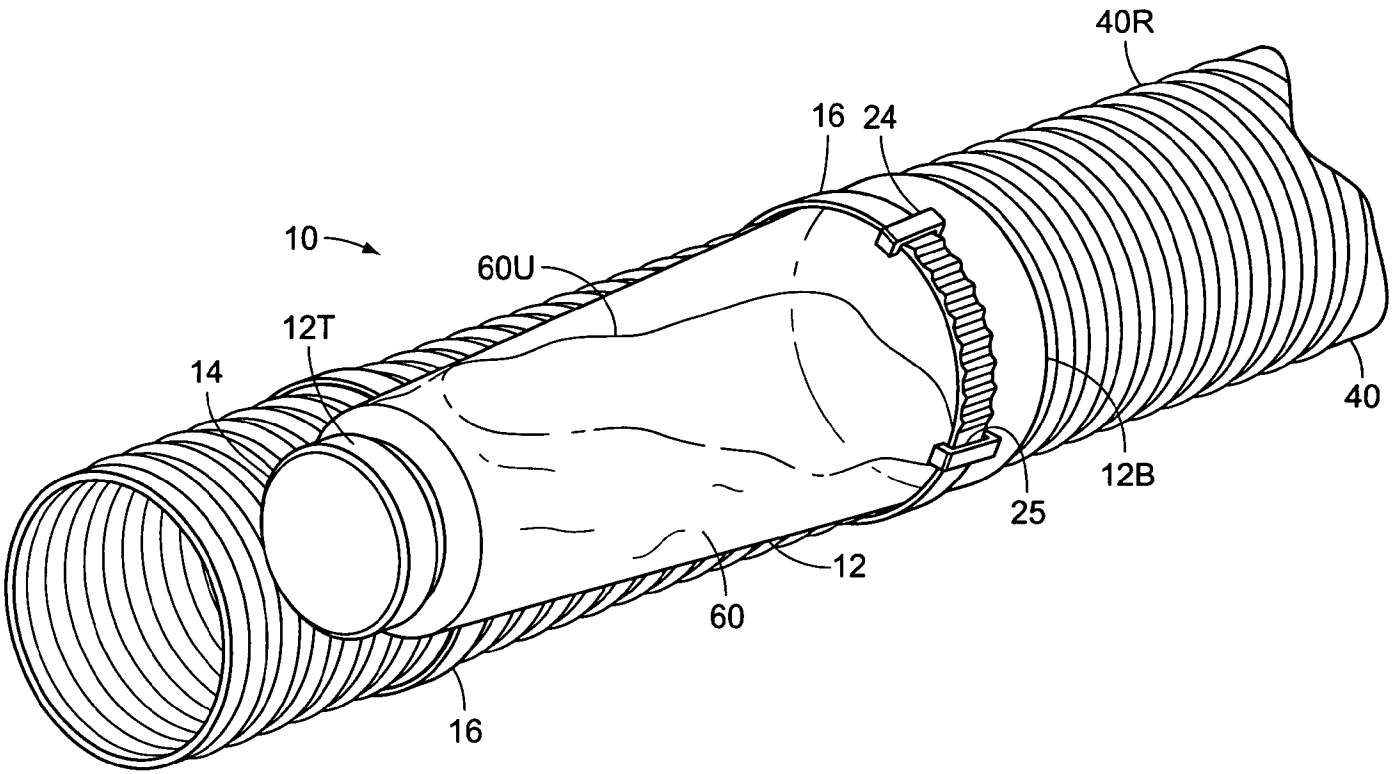
FIG. 2 is a perspective view of the hose lifter after the float has been substantially filled with water in order to decrease the buoyancy of the float, and after selective attachment to a hose of an underwater pool cleaning device, in close proximity to the body of the pool cleaning device.

FIG. 2 illustrates the hose lifter 10 after selective attachment to a swimming pool hose 40 having a plurality of raised ribs 40R. The float 12 has been substantially filled with water 60 having an upper surface 60U, in order to decrease the buoyancy of the float 12. The upper surface 60U of the water 60 is visible through the transparent float 12. One of the straps 16 has been extended through the openings 25 in the pair of strap slots 24 located in proximity to the bottom 12B of the float 12 and has been wrapped around the hose 40. The other strap 16 has been extended through the opening 25 in the strap slot 24 located in proximity to the top 12T of the float 12 and has been wrapped around the hose 40. The second end 16B of each strap 16 has been inserted into the buckle 18 at the first end 16A of the strap 16 in order to securely fasten the float 12 to the hose 40.

Figure 3:
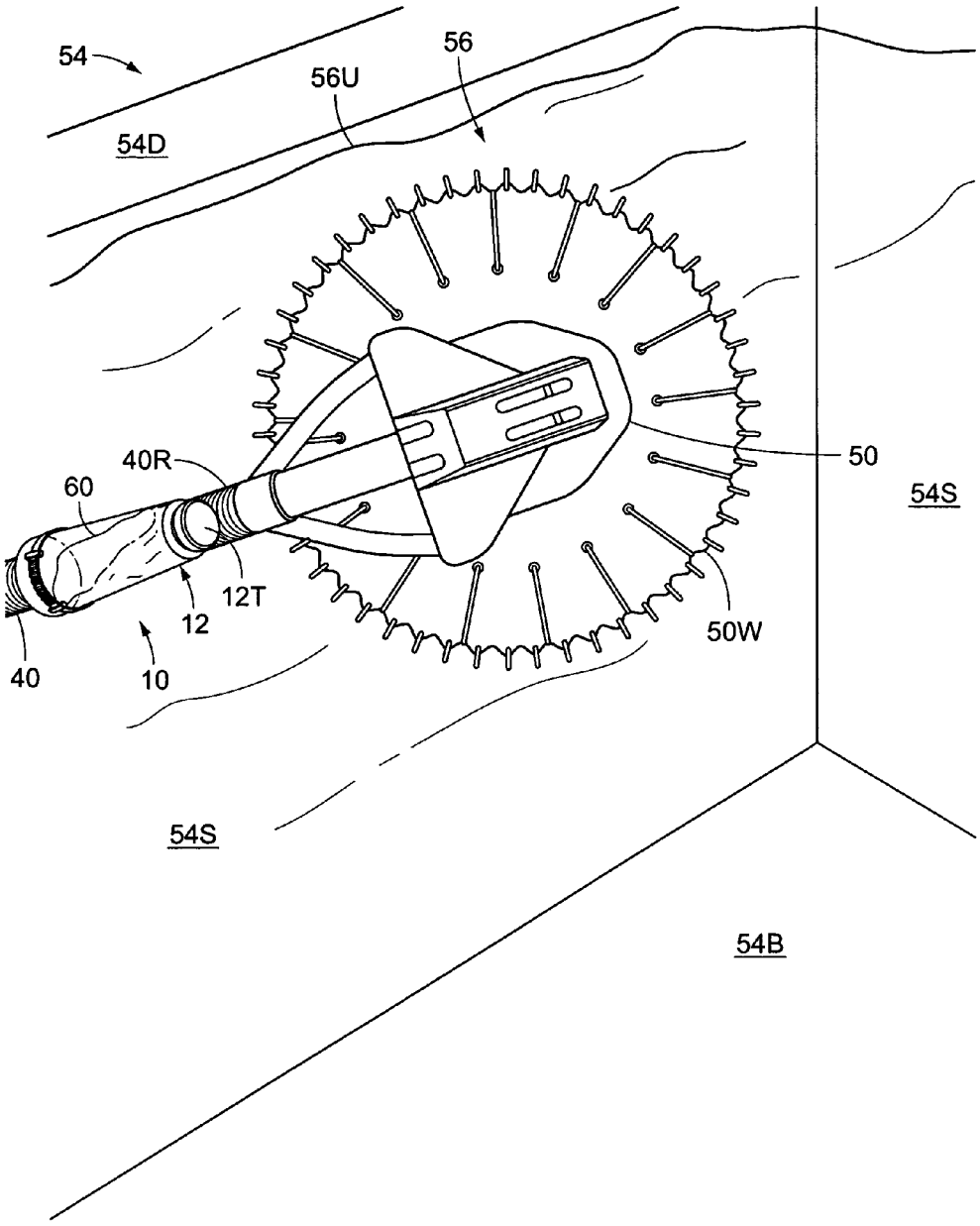
FIG. 3 is a perspective view of the hose lifter as in FIG. 2, wherein the pool cleaning device and the hose have been submerged within a swimming pool, and wherein the cleaning device is suspended at a vertically elevated position above the bottom of the pool due to the buoyancy of the hose lifter.

FIG. 3 illustrates the hose lifter 10 after selective attachment to the swimming pool hose 40 extending from an underwater pool cleaning device 50. The pool cleaning device 50 has been submerged within a swimming pool 54. The swimming pool 54 has side walls 54S, and a bottom 54B, and contains water 56 having an upper surface 56U. The side walls 54S are bordered by a deck 54D. The float 12 of the hose lifter 10 has been substantially filled with water 60. The pool cleaning device 50 has been submerged within the water 56 within the pool 54, and the cleaning device 50 is suspended at a vertically elevated position above the bottom 54B of the pool 54 due to the buoyancy of the hose lifter 10. Accordingly, the cleaning device 50 is suitably situated to suck particulate matter which has adhered to the side walls 54S at an elevated position above the bottom 54B of the pool 54, thereby making it unnecessary for the user to manually clean the side walls 54S.

The float 12 is capable of selectively holding up to approximately seven ounces of water. The hose lifter 10 is approximately seven inches long and approximately one-and-one-half inches in diameter at its widest portion. The float 12 is fashioned from a transparent plastic so that the user may readily ascertain the level of water within the float 12. In this regard, it is contemplated that the float 12 may be provided with graduated calibration marks so that the user may more accurately fill the float 12 with the amount of water necessary to achieve a particular buoyancy. The straps 16 are preferably constructed from rubber and are approximately one foot in length. The buckle 18 at the first end 16A of the strap 16 is preferably constructed from plastic.

In use, a user removes the screw cap 14 from the opening 12U at the top 12T of the float 12 and selectively fills the float 12 with an amount of water 60 needed to achieve a particular buoyancy. After the water 60 has been added to the float 12, the screw cap 14 is threaded back onto the top 12T of the float 12. The user attaches the hose lifter 10 to the hose 40 in close proximity to the cleaning device 50, and with the top 12T of the float 12 closer to the cleaning device 50 than is the bottom 12B of the float 12. The user submerges the pool cleaning device 50 within the water 56 of the swimming pool 54. The buoyant hose lifter 10 causes the cleaning device 50 to be selectively suspended in the water 56 at an elevated vertical height above the bottom 54B of the pool 54, said height being determined by the extent to which the float 12 has been filled with water 60. In particular, when the float 12 is completely filled with water 60, the cleaning device 50 will sink substantially to the bottom 54B of the pool 54, thereby allowing the user to remove particulate matter therefrom. As the user gradually empties water 60 from the float 12, the buoyancy of the hose lifter 10 increases, thereby enabling the cleaning device 50 to be suspended at progressively greater vertical heights above the swimming pool bottom 54B, and thereby enabling the cleaning device 50 to be used for cleaning portions of the side walls 54S which are at progressively greater vertical heights above the swimming pool bottom 54B.

In conclusion, herein is presented a hose lifter that selectively attaches to a hose of a pool cleaning device, and which is capable of selectively maintaining the cleaning device at an elevated position above the bottom of a swimming pool due to the buoyancy of the hose lifter. The invention is illustrated by example in the drawing figures, and throughout the written description. It should be understood that numerous variations are possible, while adhering to the inventive concept. Such variations are contemplated as being a part of the present invention.

What is claimed is:

1. A hose lifter, for use by a user in conjunction with an existing swimming pool having side walls and a bottom and containing water, and in conjunction with an existing underwater pool cleaning device having an elongated hose extending therefrom, wherein the pool cleaning device is selectively submerged within the water contained within the swimming pool while cleaning the side walls and bottom of the pool, said hose lifter for selectively maintaining the cleaning device at a vertically elevated position above the bottom of the pool, said hose lifter comprising:

a hollow transparent float having a bottom, a top having peripheral threads, an opening at the top, an external surface, a pair of spatially separated strap slots located on the external surface in proximity to the bottom, and a strap slot located in proximity to the top, each of the slots having a slot opening, said float for selective containment of an amount of water therein;

a screw cap having an internal surface having threads which match the peripheral threads of the top of the float, thereby allowing the user to selectively seal the opening of the float by threading the screw cap onto the top of the float; and two elongated straps for selectively attaching the float to a portion of the hose by extending the straps through the openings in the strap slots and wrapping the straps around the hose, each strap having a first end, a second end, and a buckle at the first end for selectively engaging the second end of the strap while the strap is being utilized to fasten the float to the hose; and wherein the buoyancy of the float may be selectively varied by the user by selectively filling the float with various amounts of water, thereby enabling the hose lifter, and the portion of the hose and the cleaning device attached thereunto, to float at different vertical levels within the water of the pool, and thereby enabling the user to use the cleaning device for cleaning portions of the side walls of the pool which are at elevated heights above the bottom of the pool.

2. The hose lifter as recited in claim 1, wherein the float is fashioned from a transparent plastic so that the user may readily ascertain the level of water within the float.

3. The hose lifter as recited in claim 2, wherein the float is tapered towards the bottom.

4. The hose lifter as recited in claim 3, wherein each strap has a plurality of lateral ribs in proximity to the second end for selectively preventing the second end of the strap from inadvertently slipping out of the buckle after the hose lifter has been selectively attached to the hose.

5. The hose lifter as recited in claim 4, wherein the hose lifter has two substantially identical straps.

6. The hose lifter as recited in claim 5, wherein the screw cap is substantially cylindrical.

7. The hose lifter as recited in claim 6, wherein the existing hose has lateral ribs, wherein each of the straps has a longitudinal slit in order that it may better engage the ribs of the hose so that the hose lifter will be maintained in the correct position upon the hose once it has been selectively affixed thereunto.

8. The hose lifter as recited in claim 7, wherein the straps are constructed from rubber.

9. The hose lifter as recited in claim 8, wherein the buckle is constructed from plastic.

* * * * *